United States Patent [19]

Laauwe et al.

[11] 4,126,224

[45] Nov. 21, 1978

[54] MOISTURE-PROOF AND CHILD-RESISTANT PILL BOX

[76] Inventors: Robert H. Laauwe, 237 Green Ridge Rd., Franklin Lakes, N.J. 07417; Stanley L. Roggenburg, Jr., 70 St. James Pl., Staten Island, N.Y. 10304

[21] Appl. No.: 848,329

[22] Filed: Nov. 3, 1977

[51] Int. Cl.[2] ..... B65D 83/04

[52] U.S. Cl. ..... 206/540; 206/1.5; 206/807; 220/295; 220/300; 220/347

[58] Field of Search ..... 206/1.5, 540, 807, 45.15; 220/345, 346, 347, 295, 297, 300; 215/222, 332

[56] References Cited

U.S. PATENT DOCUMENTS

| | | | |
|---|---|---|---|
| 2,086,534 | 7/1937 | Byrne | 206/1.5 |
| 3,072,276 | 1/1963 | Nichols | 215/222 |
| 3,451,576 | 6/1969 | Lewis | 215/222 |
| 3,888,350 | 6/1975 | Horvath | 220/347 |
| 3,942,630 | 3/1976 | Phillips | 206/1.5 |
| 3,987,891 | 10/1976 | Horvath | 220/347 |

FOREIGN PATENT DOCUMENTS

| | | | |
|---|---|---|---|
| 1,302,202 | 1/1973 | United Kingdom | 215/222 |

*Primary Examiner*—Steven E. Lipman
*Assistant Examiner*—Bruce H. Bernstein
*Attorney, Agent, or Firm*—Kenyon & Kenyon, Reilly, Carr & Chapin

[57] ABSTRACT

A pill box has a sliding cover for a bottom part having a rim on which an elastically compressible gasket is positioned, providing moisture-proofness. By a programmed squeezing together and sliding action the cover may be slid from the bottom part to gain access to the box's interior, the programmed actions making the box child-resistant. The gasket functions both as a seal and as a spring which keeps the cover and bottom part biased apart.

3 Claims, 13 Drawing Figures

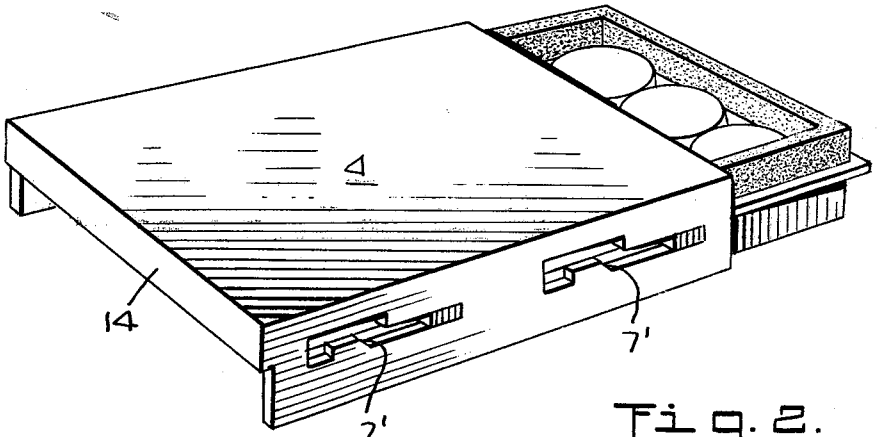
Fig. 2.
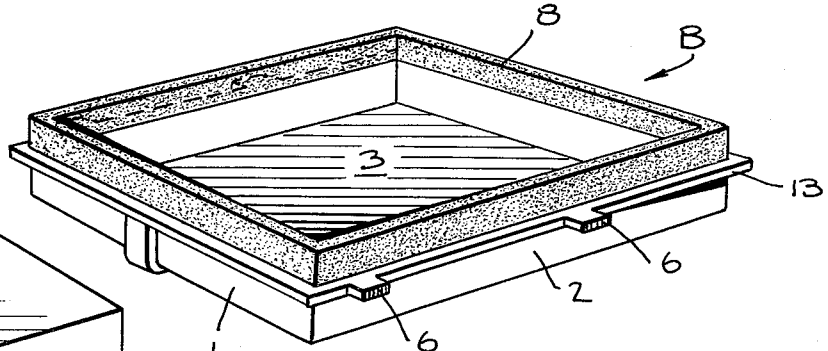
Fig. 3.
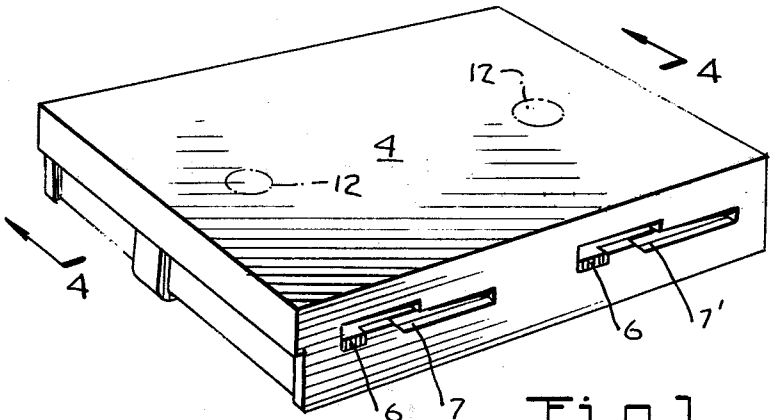
Fig. 1.
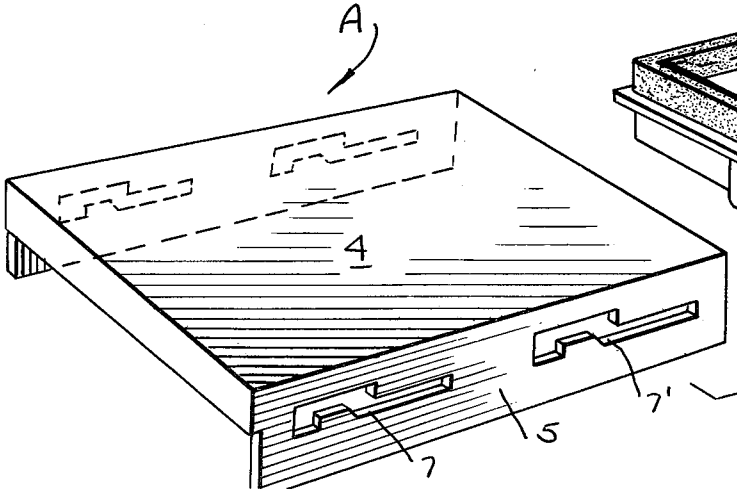

A
B
2
6
7
7a
7b
7c
7'
13

MOISTURE-PROOF AND CHILD-RESISTANT PILL BOX

BACKGROUND OF THE INVENTION

The term "pill box" embraces the small boxes in which aspirin tablets, indigestion-correcting tablets, and the like are packaged and sold.

Such a pill box can be easily carried in a pocket or pocketbook. For many years such a pill box has been exemplified by a slim hinged metal box of rectangular shape. It is no longer acceptable because of the 1972 Child Safety Act requiring any product possibly harmful to children to be packaged in an adequately child-resistant manner. The old familiar little hinged metal pill box can be opened too easily by children.

A new pill box is scheduled for commercial production and is planned for use in packaging aspirin tablets under a well-known trademark. This new box is intended to be acceptably child-resistant so as to replace the little hinged metal box which for forty years has been a tradition.

This new box is made with interlocked relatively sliding top and bottom parts, the parts being plastic moldings, the sides of the top part requiring finger squeezing to bow the top sufficiently for unlocking. Its construction is described by the Horvath U.S Pat. No. 3,888,350, June 10, 1975, which gives examples of suitable plastics as well as dimensions of the box.

This patented pill box is not moisture-proof, this term being used in the sense that the box does not protect pills against atmospheric moisture, keeping in mind that many pills have the characteristic of either sticking together or disintegrating when subjected to moisture.

The Horvath U.S Pat. No. 3,987,891, Oct. 26, 1976, discloses a child-resistant pill box which is intended also to be moisture-proof. For moisture protection intersliding rigid plastic surfaces are used which apparently are inadequate to provide effectively the desired moisture-proofness. This box, like the box of the earlier Horvath patent, is formed by rectangular rigid plastic top and bottom parts which interslide.

Such new forms of pill boxes have the advantage that the bottom or container parts can travel along on a conveyor with the top part or cover completely removed, permitting the boxes to be rapidly loaded in succession with the pills, the top part then being pressed down and snapped on the bottom part of each traveling box. This is a pill packaging advantage over the old metal box from which the hinged cover or lid cannot be removed during pill loading operations.

The object of the present invention is to improve on the pill boxes of these Horvath patents with the object of providing a box having their advantages but which is in addition even more child-resistant and which is moisture-proof to a degree assuring that the boxed pills can be kept in their originally manufactured condition when the box is exposed to atmospheric moisture.

SUMMARY OF THE INVENTION

With the above in mind, a pill box made according to the present invention comprises horizontally relatively sliding top and bottom parts each made of substantially rigid material, in the sense that plastics used in this art are rigid, the bottom part having upstanding front and back walls and side walls with the latter extending horizontally in the sliding direction of the two parts. These side walls have lugs which transversely extend from their outsides and which are horizontally interspaced in the sliding direction of the parts. The tops of these walls from a rim and on which a resilient gasket adapted for vertical elastic compressibility is positioned. By this is meant that the gasket should be thick enough in the vertical direction to permit it within reasonable limits to be compressed so that with the application of compressible force its vertical dimension decreases.

As in the case of the Horvath patent pill boxes, the top and bottom parts of the present invention are each an integral plastic molding, any of the plastics referred to by the Horvath patent being suitable. Such plastics can be considered rigid providing it is understood that they do have a certain amount of elastic deformability. Obviously the two rigid parts are adapted to be made by injection molding techniques, and with the present invention by resorting to the well-known two-shot molding techniques, the resilient gasket can by the second shot be molded onto the rim of the walls either by using a resilient or elastic plastic which can merge with or bond with the rigid plastic walls or which can be molded around a suitably shaped ridge formed on the rim and as exemplified by a ridge having a dovetail shape transversely.

The top part referred to above forms a cover for the box and it has a smooth bottom surface forming a sliding seat for the resilient gasket. In other words, the top part provides a flat wall for forming the cover and the bottom of which is smoothly finished to form the seat for the gasket. This wall has depending side flanges overlapping the bottom part's side walls and these flanges have openings into which the previously described lugs transversely project and normally hold the top and bottom parts together with the elastic or resilient gasket at least slightly compressed against the top part's seat so that the top part covers the bottom part in a substantially moisture-proof manner. In this connection it is to be understood that the bottom part forms the container for the pills or, in other words is an open-topped tray or box, the top part forming a cover for the bottom part and having the side flanges overlapping the side walls of the lower part. With the two parts slid together, the described lugs and openings hold the two parts together with the elastic or resilient gasket partially compressed and providing the moisture-proofness, or even water-tightness, to the fullest extent that can be expected of a large quantity production product.

Each of the openings in the depending flange of the top part is in the form of a slot having a first portion that extends upwardly so that the top and bottom parts can by finger pressure be forced together by further elastically compressing the already partially compressed gasket. Then the slot has a second portion that extends horizontally from the first portion so that with the gasket remaining further compressed, the top and bottom parts can be separated partially apart for the extent of this second or horizontal portion of the slot.

Each opposite two of the lugs and openings on the opposite sides of the box are mutually registered transversely of the box to form a pair and each pair is positioned so that finger pressure must be applied at interspaced locations of the box so as to make sliding apart of the box exceptionally child-resistant. In other words to initially open the box both ends of the box must be pinched together by finger pressure, followed by sliding apart of the top part or cover from the bottom part forming the pill container. The extent of this second portion of the slot is preferably made so that even if the child overcomes the obstacle of pressing both ends of the box together accompanied by a sliding motion, the box still does not open to a degree sufficient to permit the child to remove the pill's or tablets contained by the box.

With the two parts slid apart to the extent permitted initially, the two parts can be freed from pressing via their opposite ends, because the described slot of each of the openings has a third portion that returns downwardly from the end of the second portion, the slot then having a fourth portion that extends further horizontally and which to its terminal end, in the case of each of the slots and lugs, permits the top and bottom parts of the box to be slid further apart. The extent of this fourth slot of each of the openings is such that now the pills can be removed from the box.

To recapitulate, to open the box of the present invention from its moisture-proof closed condition, a person must press together both ends of the box, then slide the two box parts apart so as to partially uncover the contents but without permitting removal of the contents, it than being necessary at the termination of this sliding motion to release the pressure on the ends of the box, after which the two parts can be slid apart enough to uncover the box contents sufficiently for removal.

It can be seen that via the configuration of the slot into which the lug extends in each instance, roughly at the four corners of the box, the box opening operation is programmed, in effect, into an at least modestly complicated series of operations which can reasonably be expected to be beyond the capabilities of even the more agressive and intelligent children.

At the same time the degree of elastic resistance afforded by the elastically deformable gasket providing moisture-proofness, can be adjusted by appropriate plastic compounding techniques which are well known in the plastic injection molding industry, so that the degree of force required to press the top and bottom parts of this new box together, is well within the limits to be expected in the case of elderly and possibly arthritic persons. Mainly adult intelligence is required to open this new pill box; great force is not required. With the resilient or elastic gasket of adequate thickness vertically, a relatively light spring action is provided which can be easily overcome by finger pressure. At the same time there must be the programmed operations of first pressing together both ends of the box, because of the two interspaced pairs of lugs and slots, followed by an initial sliding apart of the box parts and which is made easily because the gasket is made of smooth surface plastic and on which the smooth bottom surface of the top part or cover can smoothly glide, at which time the limits of the first horizontal slot portions is reached with the pills partially exposed but still fully protected against removal, after which the pressure on the box ends must be released, this then being followed by the ability to slide the two parts apart far enough to permit removal of the pills.

Without relying on the use of adequate finger force to literally bow or deform the rigid plastic box parts, possibly an impossibility in the case of an arthritic person, the two parts are simply pressed together with the elastic gasket, possibly a rather soft plastic elastic gasket, compressing to permit the initial sliding apart. If the finger pressure is continued, complete opening of the box is impossible. It is necessary to know that the finger pressure must be removed from both ends of the box to thereafter open the box completely. Possibly it is not inappropriate to say this a child-proof and not merely a child-resistant box. Certainly it is appropriate to say that when the box is fully closed, moisture-proofness is assured to the highest degree reasonably possible. Furthermore, when the box is closed, it is, of course, locked closed until its ends are pressed together to permit the initial opening action.

BRIEF DESCRIPTION OF THE DRAWINGS

A specific example of this improved new pill box is, without necessarily dimensional accuracy, illustrated by the accompanying drawings in which:

FIG. 1 is a perspective view showing the new pill box in its fully closed condition;

FIG. 2 in the same way shows the box opened for removal of the pills;

FIG. 3 shows the top and bottom parts separated from each other, this also being a showing in perspective;

DETAILED DESCRIPTION OF THE INVENTION

Figure 4:
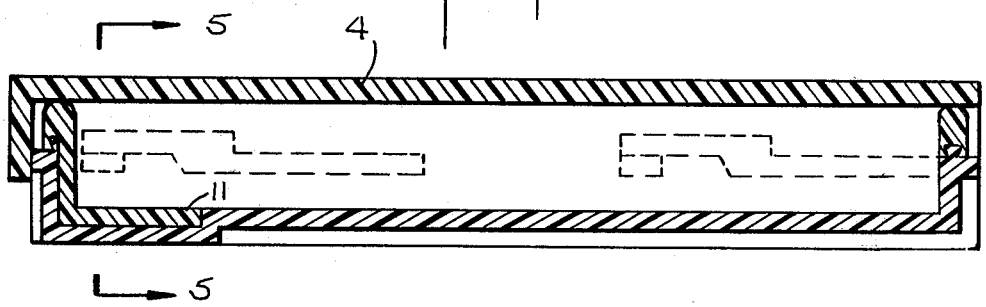
FIG. 4 is a longitudinal section taken on the line IV—IV in FIG. 1.

The general appearance of this new improved pill box is shown particularly well by FIGS. 1 through 3 with the understanding that in these views the box is shown substantially larger than it is in real life. The actual dimensions may be roughly comparable to that of the old familiar hinged metal aspirin box or, in other words, as suggested by the dimensions given by the Horvath U.S. Pat. No. 3,888,350.

The box comprises the upper part A and the lower part B, the latter having the formation of a tray or container with the front and back walls 1 and side walls 2 and, of course, a bottom wall 3. This bottom part may be injection molded of a suitable plastic having adequate rigidity and as exemplified by an injection-moldable medium impact styrene. Likewise, the top part A is also an injection molding of comparable plastic and it has the top or cover wall 4 and the two side flanges 5 which overlap the side walls 2 of the bottom part when the box is assembled as shown in FIGS. 1 and 2.

The bottom part B can be carried along on a conveyor, with a number of parts forming a series, progressively loaded with the pills, and thereafter have the top parts A snapped onto the bottom parts.

As previously described, the bottom part has its side walls 2 provided with the lugs 6 while the side walls 5 of the upper part or cover A is provided with the slots 7 through which the lugs 6 project when the two parts are snapped together. Although the plastic material has been referred to as rigid it is to be understood that all plastics suitable for injection molding into box shapes have a degree of elasticity permitting the side walls 5 of the cover or top part A to elastically spring outwardly when forced over the bottom part B, via the camming action of the lugs 6. Although not so illustrated, the top corners of the lugs 6 can be rounded or slightly beveled should this be found to be necessary for easy snapping together of the parts, an operation normally performed by the loading machine of the pill manufacturer. Once the parts are snapped together, they are for all practical purposes locked against again being separated completely.

Figure 5:
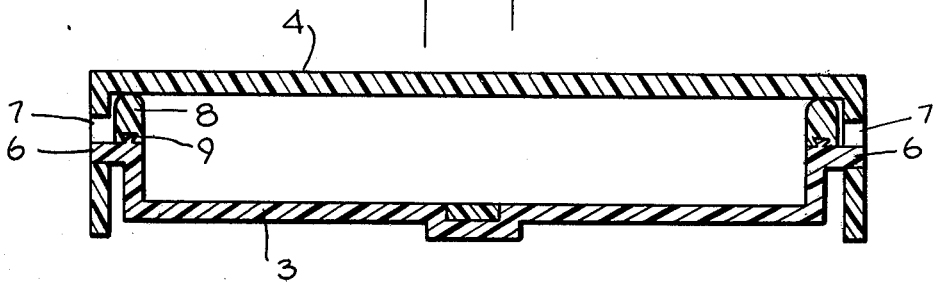
FIG. 5 is a cross section taken on the line V—V in FIG. 4 and showing the previously referred to elastically compressed gasket in its slightly or partially compressed condition as it appears when the box is closed and with the gasket providing moisture-proofness.
Figure 6:
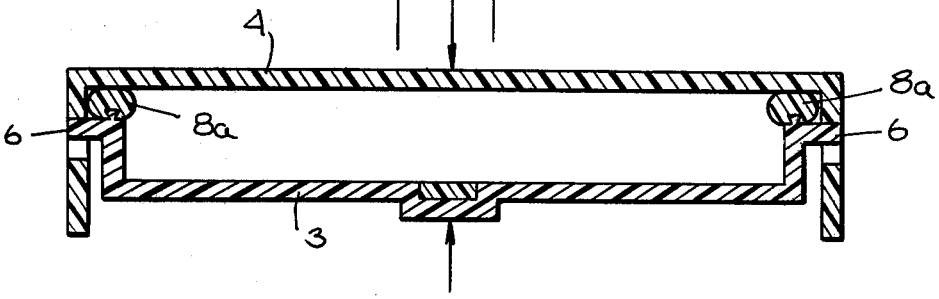
FIG. 6 is the same as FIG. 5 but shows the gasket compressed as required for the initial opening of the box and up to the limits of its partially opened condition.
Figure 7:
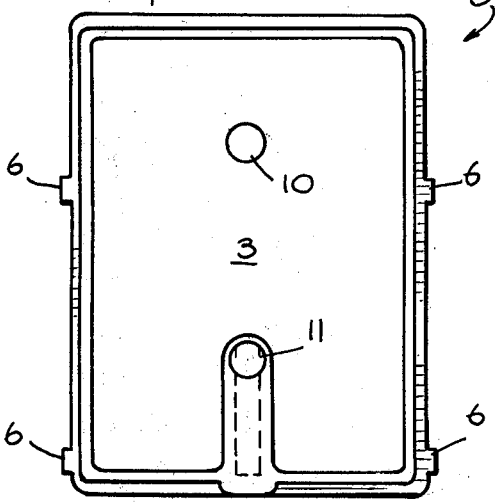
FIG. 7 is a bottom view of the bottom or container portion of the box as it is initially injection molded and prior to the second shot in the injection molding machine, required to form the elastically deformable gasket.
Figure 8:
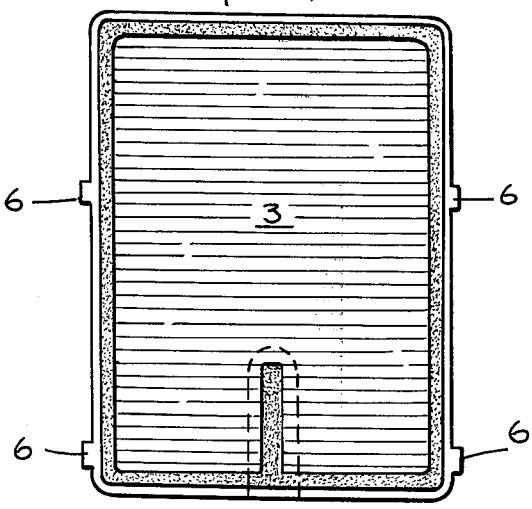
FIG. 8 is a top view of the bottom part of the box, showing the elastically resilient gasket more or less integrally molded on the rim of the bottom part, by the second shot in the injection molding machine.

The gasket made of vertically elastically compressible material is shown at 8 positioned on top of the rim of the walls 1 and 2 and shown by FIGS. 4 through 6 as being formed with a dovetail cross section, illustrated at 9 in those figures. This gasket may be made of any of the plastics which in final form are elastically or resiliently deformable, exemplified by an injection moldable elastomeric polyester. Although this gasket can be preformed and during the manufacture of the box by the box manufacturer manually or possibly by automation snapped onto the dovetail rim 9, which incidentally can have other cross-sectional shapes, it is considered preferable from the view of economical manufacture, to resort to the two-shot injection molding technique. FIGS. 7 and 8 serve to show the first shot gate 10 through which the ultimately rigid plastic is injection molded into the box die, thereafter being shifted to the gasket die cavity for the second shot made via the gasket gate 11, the elastomeric polyester, for example, being then injection molded to form the gasket 8 via this second shot. By this familiar two-shot practice, the complete bottom parts B can leave the die cavities of the injection-molding machine as complete units.

Excepting for the gasket, both of the parts A and B are integral plastic moldings in the sense that all of their various parts represent a single molding, in each instance. The elastically deformable or soft plastic gasket is a separate part but can be considered as integral with the bottom part B when made by the two-shot practice.

It is this gasket 8 that functions as both a moisture-proof seal and a spring. The box is opened by the applicaton of pressure at the points 12 indicated in FIGS. 1 and 2. This is normally a two-hand operation, and although the pressure points 12 might be visually indicated on the box top or cover, it is necessary for a child to press on both points simultaneously. An adult capable of exerting greater finger pressure might be able to open the box initially by pressing exactly on the center of the box top but this requires the greater finger pressure and precision location of the fingers. The normal way to open the box is to press at both points 12.

Figures 9, 10, 11, 12, 13:
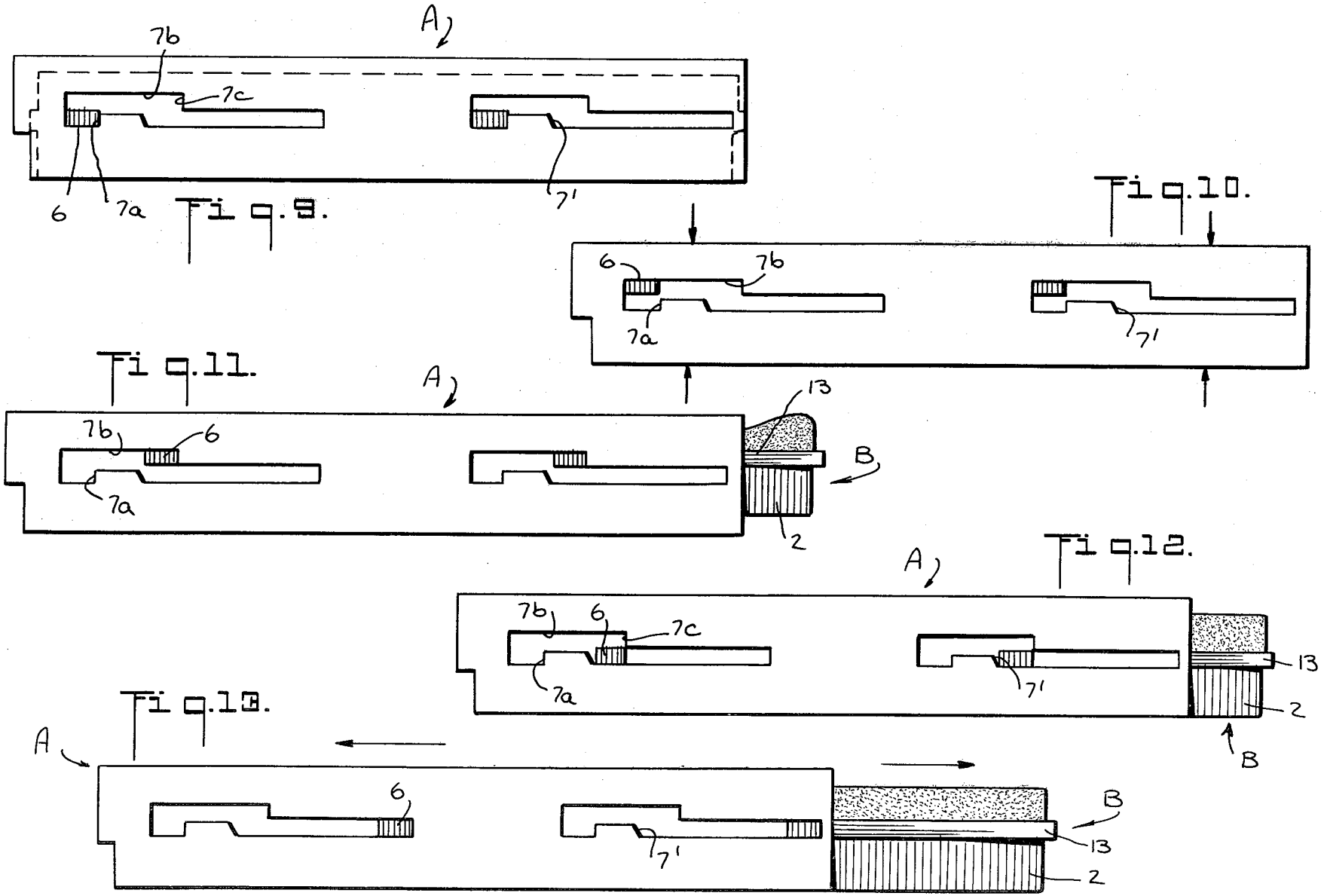
FIG. 9 is a side elevation of the box showing the lug and slot arrangement when the top of the box is closed and locked on the bottom part.
FIG. 10 shows how the FIG. 9 viewing changes when the opposite ends of the box are pinched together.
FIG. 11 in the same way shows the second phase of the programming when the two box parts have been slid apart to the extent permitted by the second portions of the slots which extend horizontally, further sliding being impossible at this point if the pressure on the ends of the box is continued.
FIG. 12 shows how with the finger pressure removed the lugs are dropped to the bottom of the third or second vertical portions of the slots so that everything is clear for the final opening.
FIG. 13 shows the final sliding action permitting opening of the box and use of the contents of the box.

The slot portions of the openings 7 are shown in detail by FIGS. 9 through 13. FIG. 9 shows the first or vertical slot *7a* in which the lugs 6 at each of the four openings is normally held in a locked position by the springing apart of the gasket 8, FIGS. 4 and 5 showing the appearance of the gasket 8 as it is lightly compressed when the box is closed, the compression being adequate for effective moisture-proofness.

FIG. 10 shows how the lugs 6 have been lifted from the slots *8a* by finger pressure on the opposite ends of the box with the gasket deforming as shown at *8a* in FIG. 6. With this greater elastic compression of the gasket, the lugs 6 are now free, by sliding action of the cover relative to the bottom part of the box, to travel through the short horizontal or second slot portion *7b* to ultimately arrive at the terminal end of this portion *7b* as illustrated by FIG. 11. This permits separation of the parts to a degree limited by the extents of the slot portions *7b*, these, in turn, being proportioned so that the pills in the bottom part are only partially exposed but not removable. Release of finger pressure on the box ends permits the lugs 6 to drop down in the short or third slot portions *7c*. The principle is that if a child actually succeeded in pressing both ends of the box at once adequately and to actually partially slide the two box parts apart, the child will become discouraged when coming to an abrupt halt under the conditions illustrated by FIG. 11. The tendency then would be, if anything, to move the parts backwardly which would then only result in relocking the parts together with the lug positions being as shown at FIG. 9 again. There must be a realization that at this point, in FIG. 12, the box can be opened for the removal of the pills by the complete sliding action illustrated by FIG. 13.

In other words, possibly by printed instructions on the box which would be hopefully unintelligible to children too young to know the danger of haphazard pill-taking, the adult user can be informed of the program of pressure applying and sliding and pressure release operations required to gain access to the box. The box is provided with what is, in effect, a combination lock requiring intelligence for its operation. At the same time, great strength is not required because the gasket which functions both as the moisture-proof seal and the spring working the combination lock or programming system in conjunction with finger pressure, need not necessarily be very stiffly elastic.

In connection with the above, a gasket formed by a die, either as a separately formed injection molded product or as a two-shot product formed directly on the rim of the box, inherently has a smooth final surface formed by the polished surfaces of the die. For the same reason, the bottom side of the injection molded top or cover part A and which forms a sliding seat for the gasket, is also a very smooth surface and, in fact, may actually have a shiny finish. Therefore, the two intersliding intersealing surfaces of the gasket and the bottom side of the wall 4 of the top part, provide for relatively small frictional resistance to sliding even when the gasket is compressed to the fullest possible extent, as indicated by FIG. 6. Arthritic hands are easily able to open this improved box; the percentage of chance of a child opening the new box is very small. Additionally, the smoothness possible in the case of the intersealing surfaces provides for excellent moistureproofness.

For emphasis, the two sets of slots and lugs on opposite side of the box, in each instance, form a pair which are transversely registered with respect to each other and each pair is longitudinally interspaced with respect to the sliding direction of the box, both pairs preferably being positioned rather adjacent to the opposite box ends respectively. This provides the two pressure points 12 indicated by the first few figures of the drawings.

To further ease the sliding action once the combination is operated according to the programming, the bottom part can be provided with a rib 13 providing a sliding surface of reduced area and, therefore, reduced frictional restraint. This rib is not a necessity. The drawings also show the top part A with one end necessarily opened so the bottom part can slide out, but with the other end having a short depending wall 14. This again is not a necessity because the sliding limits of the two parts are fixed by the programming slots of the opening 7. Once the two parts are slid together to the position shown by FIG. 1, the moisture-proof characteristic becomes fully effective whether or not there is a partial or complete end wall opposite to the opending end of the upper art A.

Before closing, it is again pointed out that the drawings are not dimensionally precise. For example, the gasket 8 is shown by FIGS. 2 and 3 with a somewhat exaggerated height. The gasket need only be thick enough vertically to perform its sealing and spring functions which possibly depend, in turn, on the elastically deformable properties of the plastic used. The combination of motions required to open the box need not be repeated for closing, because as shown at 7' in the drawings, the shoulders which form the jog of the openings can be inclined to provide a cam action during closing. With this arrangement it is only necessary to push the cover closed, the cover camming up and then snapping down locked. The principles of the present invention can be applied to containers other than boxes, and when in box form, the contents need not necessarily be tablets, pills and the like; the new box can be used as a moisture-proof matchbox, for example. The use of the elastic gasket, whether mechanically applied when made separately, or injection molded on the bottom part's rim via a two-shot injection-molding machine, has the advantage of permitting the bottom part to be made of relatively rigid plastic, the gasket having any degree of elastic deformability desired. To obtain even an approach towards moisture-proofness, the box of the Hovarth U.S. Pat. No. 3,987,891 must use a relatively more elastic plastic for the bottom part or drawer so that the rim of that part has at least some elastic deformability which, in turn, results in the bottom part or drawer being elastically deformable so much that it acquires a floppy characteristic which is undesirable. In the case of the earlier Horvath patent box, it is the top that must be made elastic enough to be springy enough to permit the opening action. The top and bottom parts of the box of the present invention can be made rigid to a degree avoiding any feeling of floppiness or deformability but the two parts need not be excessively rigid. Rigidity and elasticity can be considered as relative terms or matters of degree, the degree being obtained by the selection of the plastics used and by their compounding.

What is claimed is:

1. A substantially moisture-proof and child-resistant pill box comprising horizontally relatively sliding top and bottom parts each made of substantially rigid material, said bottom part having upstanding front and back walls and side walls extending horizontally and lugs transversely extending from the outside of each side wall and which are horizontally interspaced, the tops of said walls forming a rim and on which a resilient gasket adapted for vertical elastic compressibility is positioned; said top part forming a cover for the box and having a bottom surface forming a sliding seat for said gasket and having depending flanges overlapping the bottom part's side walls and the flanges having openings into which said lugs transversely project and normally hold said top and bottom parts together with said gasket at least slightly compressed against said seat of the top part so that the latter covers the bottom part in a substantially moisture-proof manner; each of said openings being in the form of a slot having a first portion that extends upwardly so that the top and bottom parts can by finger pressure be moved together by further elastically compressing said gasket, and having a second portion that extends horizontally from the first portion so that with the gasket remaining further compressed the top and bottom parts can be slid partially apart for the extent of said second portion, the slot then having a third portion that extends downwardly so as to permit the lug to return downwardly with consequent release of the gasket's further compressed state when said finger pressure is released, and the slot having a fourth portion that extends further horizontally and permits the top and bottom parts to be slid further apart for the extent of said fourth slot; each opposite two of said lugs and openings on the opposite sides of the box being mutually registered transversely of the box to form a pair and each pair being positioned so that said finger pressure must be simultaneously applied at interspaced locations of the box so as to make sliding apart of the parts child-resistant.

2. The pill box of claim 1 in which said top and bottom parts are each an integral plastic molding and said gasket is formed by a plastic molded on said rim.

3. A substantially moisture-proof and child-resistant pill box comprising horizontally relatively sliding top and bottom parts each made of substantially rigid material, said bottom part having upstanding front and back walls and side walls extending horizontally, the tops of said walls forming a rim and on which a resilient gasket adapted for vertical elastic compressibility is positioned; said top part forming a cover for the box and having a bottom surface forming a sliding seat for said gasket and having depending flanges overlapping the bottom part's side walls, said flanges and side walls forming mutually opposed parts of which one has horizontally interspaced lugs transversely extending towards the other part, the other of said parts having openings into which said lugs transversely project and normally hold said top and bottom parts together with said gasket at least slightly compressed against said seat of the top part so that the latter covers the bottom part in a substantially moisture-proof manner; each of said openings being in the form of a slot having a first portion that extends upwardly so that the top and bottom parts can by finger pressure be moved together by further elastically compressing said gasket, and having a second portion that extends horizontally from the first portion so that with the gasket remaining further compressed the top and bottom parts can be slid partially apart for the extent of said second portion, the slot then having a third portion that extends downwardly so as to permit the lug to return downwardly with consequent release of the gasket's further compressed state when said finger pressure is released, and the slot having a fourth portion that extends further horizontally and permits the top and bottom parts to be slid further apart for the extent of said fourth slot; each opposite two of said lugs and openings on the opposite sides of the box being mutually registered transversely of the box to form a pair and each pair being positioned so that said finger pressure must be simultaneously applied at interspaced locations of the box so as to make sliding apart of the parts child-resistant.

* * * * *